US005701778A

United States Patent [19]

Kirii

[11] Patent Number: 5,701,778

[45] Date of Patent: Dec. 30, 1997

[54] PRESS HAVING GAS CYLINDERS OF PLASTICALLY DEFORMABLE MEMBERS FOR EVEN DISTRIBUTION OF BLANK-HOLDING FORCE ON PRESSURE MEMBER THROUGH CUSHION PINS

[75] Inventor: Kazunari Kirii, Aichi-ken, Japan

[73] Assignee: Toyota Jidosha Kabushiki Kaisha, Japan

[21] Appl. No.: 397,848

[22] Filed: Mar. 2, 1995

[30] Foreign Application Priority Data

Mar. 3, 1994 [JP] Japan ..... 6-033522

[51] Int. Cl.[6] ..... B21D 24/08

[52] U.S. Cl. ..... 72/351; 72/465

[58] Field of Search ..... 72/350, 351, 453.07, 72/465, 453.13; 267/119

[56] References Cited

U.S. PATENT DOCUMENTS

| | | | |
|---|---|---|---|
| 1,503,105 | 7/1924 | Balcker | 72/453.07 |
| 1,970,134 | 8/1934 | Ferris | 72/358 |
| 4,414,836 | 11/1983 | Saunders | 72/350 |
| 4,499,750 | 2/1985 | Gerber et al. | 72/351 |
| 4,592,220 | 6/1986 | Martinez et al. | 72/16 |
| 4,601,190 | 7/1986 | Schneider et al. . | |
| 4,610,156 | 9/1986 | Kaminski et al. | 72/465 |
| 4,635,446 | 1/1987 | Meckler | 62/271 |
| 4,669,298 | 6/1987 | Kono et al. | 72/453.13 |
| 4,821,552 | 4/1989 | Baur et al. | 72/351 |
| 5,003,807 | 4/1991 | Terrell et al. | 72/351 |
| 5,295,383 | 3/1994 | Kirii et al. . | |
| 5,299,444 | 4/1994 | Kirii et al. . | |

FOREIGN PATENT DOCUMENTS

| | | |
|---|---|---|
| 2046914 | 6/1991 | Canada . |
| 2077510 | 9/1992 | Canada . |
| 2077595 | 9/1992 | Canada . |
| 0173755 | 3/1986 | European Pat. Off. . |
| 0 312 809 | 4/1989 | European Pat. Off. . |
| 0 365 317 | 4/1990 | European Pat. Off. . |
| 0 531 141 | 3/1993 | European Pat. Off. . |
| 0531141 | 3/1993 | European Pat. Off. . |
| 2 667 257 | 4/1992 | France . |
| 24 07 864 | 8/1975 | Germany . |
| 4128973 | 4/1992 | Germany . |
| 41 01 606 | 7/1992 | Germany . |
| 55-97819 | 7/1980 | Japan . |
| 60-108429 | 7/1985 | Japan . |
| 1-249227 | 10/1989 | Japan . |
| 5-57362 | 3/1993 | Japan . |
| 5-57363 | 3/1993 | Japan . |
| 5-69050 | 3/1993 | Japan . |
| 5-285556 | 11/1993 | Japan . |

OTHER PUBLICATIONS

"Concise Explanation of Relevance of Non-English Prior Art Documents Cited in IDS".

*Primary Examiner*—Lowell A. Larson

*Attorney, Agent, or Firm*—Finnegan, Henderson Farabow, Garrett & Dunner, L.L.P.

[57] ABSTRACT

A press including force applying means for producing a blank-holding force, a cushion pad which receives the blank-holding force when the cushion pad is lowered, cushion pins disposed on the cushion pad, and a pressure member supported by the upper ends of the cushion pins, so that the blank-holding force is transferred to the pressure member through the cushion pins to hold a blank placed on the pressure member, when the pressure member is moved down during a pressing operation on the blank. A plurality of mutually independent balancing members, such as gas cylinders each filled with a gaseous fluid, or plastically deformable members, are disposed in respective transfer paths of the blank-holding force between the pressure member and the respective cushion pins.

17 Claims, 8 Drawing Sheets

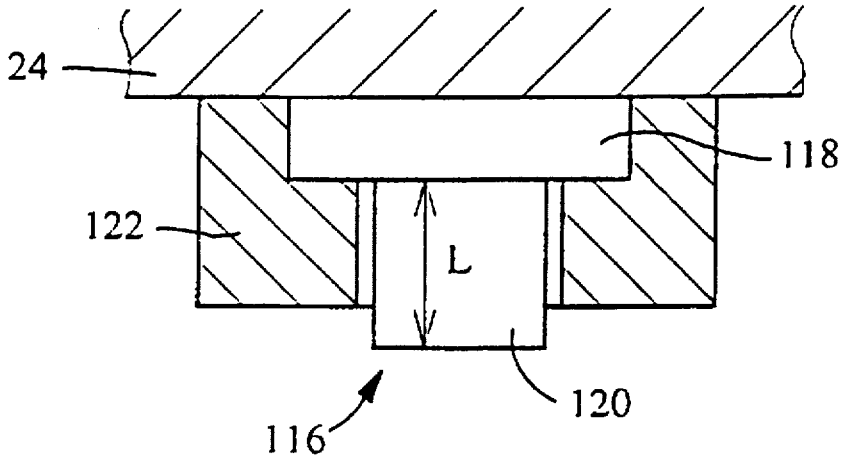
FIG. 7
FIG. 8
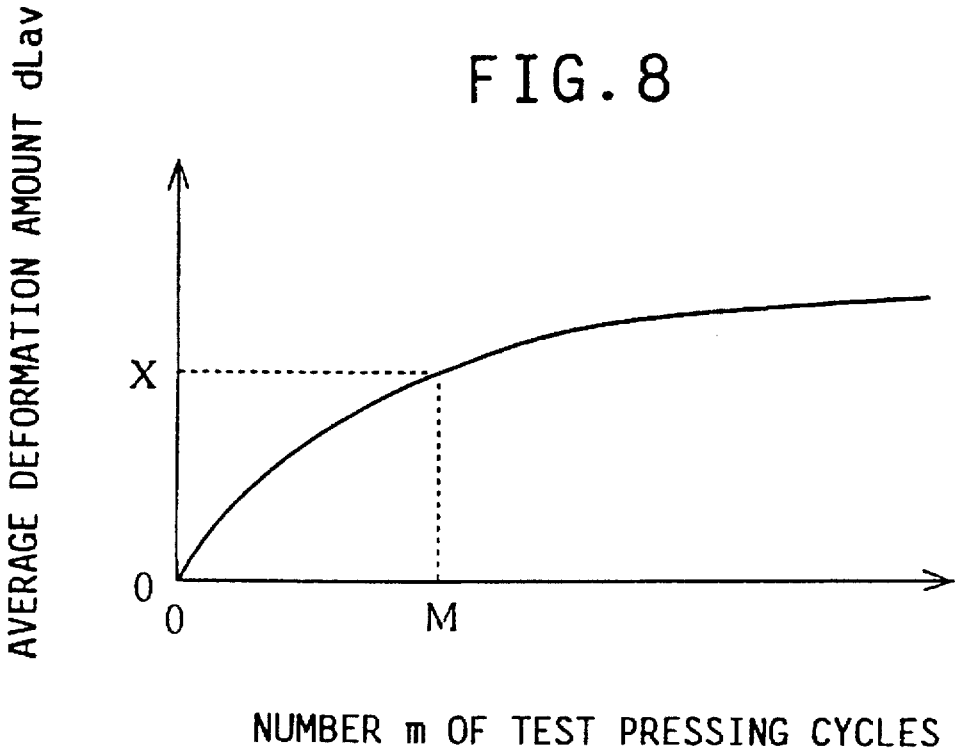

PRESS HAVING GAS CYLINDERS OF PLASTICALLY DEFORMABLE MEMBERS FOR EVEN DISTRIBUTION OF BLANK-HOLDING FORCE ON PRESSURE MEMBER THROUGH CUSHION PINS

BACKGROUND OF THE INVENTION

1. Field of the Invention

The present invention relates in general to a press of the type in which a blank-holding force is transferred to a blank through a plurality of cushion pins and a pressure member. More particularly, the invention is concerned with technical improvements for substantially even distribution of the blank-holding force to the individual cushion pins.

2. Discussion of the Related Art

There is known a press of the type including (a) a cushion pad which receives during its downward movement a blank-holding force from force applying means, and (b) a plurality of cushion pins which are placed at their lower ends on the cushion pad and which support at their upper ends a pressure member for holding a blank, and wherein the blank-holding force is transferred to the pressure member through the cushion pins when the pressure member is lowered during a pressing operation on the blank. The force applying means may include a pneumatic cylinder adapted to bias the cushion pad in the upward direction for producing the blank-holding force, or a hydraulic cylinder and pressure relief means for discharging a working oil from the hydraulic cylinder during the downward movement of the cushion pad, so as to produce the blank-holding force based on the relief pressure.

There is also known a press of the type in which a plurality of balancing hydraulic cylinders are disposed on the cushion pad. The hydraulic cylinders are linked with the lower ends of the respective cushion pins, so that the blank-holding force is evenly distributed over the entire area of the pressure member, with substantially equal components of the blank-holding force acting on the individual cushion pins, irrespective of dimensional and positional errors of the press such as inclination of the cushion pad with respect to the horizontal plane, dimensional variations of the cushion pins and pressure member from the nominal values. The balancing hydraulic cylinders have oil chambers communicating with each other for free flows of the working oil through the oil chambers, so that the pistons which are movable in the oil chambers and are linked or associated with the lower ends of the cushion pins are lowered by different distances corresponding to the length variations of the cushion pins, for example, so as to absorb the dimensional and positional errors of the press, for thereby assuring substantially even distribution of the blank-holding force to the cushion pins through the working oil mass in the oil chambers. Examples of the press provided with such balancing hydraulic cylinders are disclosed in laid-open Publication No. 60-108429 (published in 1985) of Japanese Utility Model Application and laid-open Publication No. 5-69050 (published in 1993) of Japanese Patent Application.

However, the use of such balancing hydraulic cylinders for even distribution of the blank-holding force requires piping conduits and manifold for mutual connection of the oil chambers of the hydraulic cylinders. Further, the press requires a large number of such balancing hydraulic cylinders arranged in a matrix form, which correspond to the positions at which the cushion pins are selectively disposed depending upon the specific kinds (specific shapes and sizes) of die sets. Each of these die sets includes the pressure member, a lower die, and an upper die which cooperate to hold the blank during a pressing operation on the blank. Described in detail, the number of the balancing hydraulic cylinders (cushion pins) actually required for pressing operations with various die sets is usually within a range of about 20–60. For facilitating the pressing operations by selective use of the various die sets, however, about 120 balancing hydraulic cylinders must be permanently disposed on the cushion pad, since it is difficult to change the number and positions of the hydraulic cylinders disposed on the cushion pad each time a new die set is used. Namely, disconnection and re-connection of the hydraulic cylinders for changing the number and positions of the cylinders depending upon the specific kind of the die set to be used are not practically feasible. Thus, the provision of the balancing hydraulic cylinders requires a complicated and large-sized hydraulic system, and also a relatively large space for installation of the hydraulic cylinders. Therefore, it is difficult to retrofit an existing press for the provision of the balancing hydraulic cylinders. Even if a new press is designed with the balancing hydraulic cylinders, the cost of manufacture of the press is considerably increased.

SUMMARY OF THE INVENTION

It is therefore an object of the present invention to provide a press which is simple in construction and economical to manufacture and which assures substantially even distribution of the blank-holding force over the entire area of the pressure member through a plurality of cushion pins.

The above object may be achieved according to the principle of the present invention, which provides a press including (a) force applying means for producing a blank-holding force, (b) a cushion pad which receives the blank-holding force when the cushion pad is moved down, (c) a plurality of cushion pins disposed on the cushion pad, and (d) a pressure member supported by the cushion pins at upper ends of the cushion pins remote from the cushion pad, so that the blank-holding force is transferred to the pressure member through the cushion pins to hold a blank placed on the pressure member, when the pressure member is moved down during a pressing operation on the blank, the press being characterized by a plurality of mutually independent balancing members disposed in respective transfer paths of said blank-holding force which correspond to said plurality of cushion pins. The balancing members are constructed to establish substantially even distribution of the blank-holding force over a substantially entire area of the pressure member through the cushion pins.

In the present press constructed as described above, the mutually independent balancing members are disposed corresponding to the respective cushion pins in the respective transfer paths of the blank-holding force generated by the force applying means. During a pressing operation on the blank, the blank-holding force is transferred through the balancing members such that the blank-holding force is substantially evenly distributed over the pressure member through the cushion pins, which are arranged so as to meet the specific configuration of the die set including the pressure member. The present press is simpler in construction and less costly than the conventional press which uses a relatively large number of balancing hydraulic cylinders whose fluid chambers are connected to each other.

In a first preferred form of the present invention, the plurality of mutually independent balancing members consist of a plurality of gas cylinders each filled with a gaseous fluid. The gas cylinders are disposed in the respective transfer paths of the blank-holding force which correspond to the plurality of cushion pins, respectively. During a pressing operation on the blank, the pistons of the gas cylinders are moved down so as to compress the gas in the gas cylinders, so that the blank-holding force is transferred through the compressed gas to the pressure member. The pistons of the individual gas cylinders are moved down by different distances, due to dimensional and positional errors of the press such as some inclination of the cushion pad, length variations of the cushion pins and dimensional errors of the pressure ring. Accordingly, the gas pressures in the individual gas cylinders differ from each other, whereby the forces that are transferred through the gas cylinders differ from each other. However, the relationship between the force transferred through each gas cylinder (gas cylinder force) and the distance of downward movement of its piston can be comparatively freely determined or set by suitably determining the initial gas pressure, pressure-receiving area of the piston, and volume of the gas chamber. Thus, the difference of the gas cylinder forces due to the different downward movement distances of the pistons of the individual gas cylinders can be reduced to within a permissible range that does not cause a significant influence on the distribution of the blank-holding force on the pressure member, or a significant influence on the quality of the products obtained from the blanks. In other words, the gas cylinders permit substantially even distribution of the blank-holding force to the cushion pins, which are arranged so as to meet the specific configuration of the die set including the pressure member.

The gas cylinders may be permanently disposed or installed at predetermined multiple positions arranged in a matrix form so as to cover the entire area of the pressure member, like the conventional balancing hydraulic cylinders. However, upon exchanging the die sets, the desired number of the gas cylinders may be installed at the desired or selected positions, which are alinged with the positions of the cushion pins. The number and positions of the cushion pins and gas cylinders to be installed are determined depending upon the specific die set to be used. Namely, since the gas cylinders are not connected to each other but are independent of each other, the number and positions of the gas cylinders installed can be easily changed.

It is noted that even if the conventional balancing hydraulic cylinders were used in place of the present gas cylinders such that the hydraulic cylinders are independent of each other, the forces transferred through these hydraulic cylinders (hydraulic cylinder forces) would greatly differ from each other due to even a small difference of the downward movement distances of the pistons, since the modulus of elasticity of volume (bulk modulus) of a hydraulic fluid is extremely larger than that of a gaseous fluid. Therefore, the mutually independent hydraulic cylinders do not permit even distribution of the blank-holding force. It is theoretically possible to reduce the amount of difference of the hydraulic cylinder forces to within a permissible range, by increasing a ratio of the fluid chamber volume of the hydraulic cylinder to the pressure-receiving area of its piston, to reduce the amount of volumetric change of the hydraulic fluid per unit movement distance of the piston and to thereby reduce the amount of change of the hydraulic cylinder force. This means that the hydraulic cylinders should have an extremely large size. In practice, therefore, the hydraulic cylinders cannot be used in place of the gas cylinders, except in a rare case where the variation of the downward movement distances of the pistons of the hydraulic cylinders is very small with extremely small dimensional and positional errors of the press.

In the present preferred form of the press, the desired number of the gas cylinders filled with a suitable gaseous fluid are mutually independently disposed at the desired positions in the respective transfer paths of the blank-holding force corresponding to the respective cushion pins. The number and positions of the gas cylinders to be disposed can be selected or changed as needed, so as to assure even distribution of the blank-holding force over the entire area of the pressure member, depending upon the specific size and shape of the die set to be used. Upon setup of the press involving an exchange of the die sets, the already installed gas cylinders may be removed from the press or moved to the other positions as needed, or the new gas cylinders are installed at the desired positions. Further, the number of the gas cylinders that should be prepared for a given press is the expected maximum number of the gas cylinders to be used with the largest die set. This is not so in a conventional press in which a relatively large number of hydraulic cylinders are permanently installed such that the fluid chambers are connected to each other for fluid communication as described above. Accordingly, the present press is simpler in construction and less costly than the conventional press. Furthermore, the principle of the present invention using the mutually independent gas cylinders is applicable to an existing press which is not equipped with any balancing means for even distribution of the blank-holding force.

The piston rod of each gas cylinder may be held in abutting contact with the lower or upper end face of the corresponding cushion pin.

In one advantageous arrangement of the present first preferred form of the invention, however, the piston rod is fixed to the lower or upper end of the corresponding cushion pin. For example, the piston rod of each gas cylinder may be formed as an integral part of the corresponding the cushion pin. Where the piston rods of the gas cylinders are fixed to or integrally formed with the corresponding cushion pins, the cushion pins and gas cylinders can be more easily installed and positioned with higher efficiency than in the case where the separate cushion pins and gas cylinders are installed such that the piston rods of the gas cylinders are held in abutting contact with the lower or upper end faces of the cushion pins, for example.

In the conventional press with the multiple hydraulic cylinders permanently installed in a matrix form, the positions at which the cushion pins can be installed are determined or restricted by the positions of the hydraulic cylinders, and the cushion pins cannot be disposed at the desired or optimum positions in some cases when the die set has a relatively small size. According to the preferred form of the invention in which each gas cylinder is fixed to or integral with the corresponding cushion pin, the cushion pins may be positioned by a lower die of the die set such that the cushion pins are arranged at the desired positions on the lower die, even if the size of the lower die is relatively small. In other words, each of the lower dies of the die sets to be used has a suitable number of through-holes formed at the desired positions so that the cushion pins with the gas cylinders integrally attached thereto extend through the respective through-holes. The number and positions of these through-holes may be suitably determined, depending upon the size and shape of the lower die, so as to assure even distribution of the blank-holding force.

In another advantageous arrangement of the press using the gas cylinders as the mutually independent balancing members, each of the gas cylinders comprises a cylinder housing having a plurality of piston chambers, a plurality of pistons slidably received in the piston chambers, respectively, and a piston rod connected to the plurality of pistons such that the pistons are moved together as a unit. The piston chambers are arranged in the direction of movement of the pistons.

Since the gas cylinder described above has the two or more axially spaced piston chambers and the pistons which are slidably received in the piston chambers and connected to each other by the piston rod, the pistons have a sufficiently large pressure-receiving area while maintaining the diameter of the cylinder housing at a relatively small value. Accordingly, the gas cylinder is capable of producing a sufficiently large force without an increase of its diameter. In other words, the installation space required for each gas cylinder in a plane parallel to the cushion pad can be made relatively small while enabling the gas cylinder to produce a sufficiently large force. Thus, the gas cylinders and the cushion pins can be disposed at the desired positions for intricate control of the distribution of the blank-holding force, substantially in the same manner as in the press equipped with the conventional hydraulic cylinders. Although the gas cylinder force can be increased by increasing the initial gas pressure in the gas cylinder, the gas pressure has an upper limit, and the gas cylinder force cannot be sufficiently increased without increasing the pressure-receiving area of the gas cylinder.

In the above arrangement, each piston chamber may be divided by the corresponding piston into a gas chamber filled with the gaseous fluid and an atmospheric chamber communicating with an atmosphere, and the gas chambers in the piston chambers communicate with each other.

In a second preferred form of the present invention, the plurality of mutually independent balancing members consist of a plurality of deformable members disposed in the respective transfer paths of the blank-holding force which correspond to the respective cushion pins. The deformable members are plastically deformable by application thereto of the blank-holding force during the pressing operation. The present form of the invention is based on a fact that the components of the blank-holding force transferred through the individual cushion pins to the pressure member initially differ from each other due to dimensional and positional errors of the press such as the inclination of the cushion pad and the dimensional variations of the cushion pins and pressure member from the nominal values. As the pressing operation is repeatedly performed, the deformable members are gradually plastically deformed by different amounts depending upon the different force components applied thereto through the respective cushion pins. The different amounts of plastic deformation of the cushion pins absorb or accommodate the dimensional and positional errors of the press, so that the force or load components transferred through the individual cushion pins to the pressure member are made substantially equal to each other, whereby the blank-holding force is substantially evenly distributed over the entire area of the pressure member through the cushion pins and the deformable members.

Prior to an actual production run of the press, test pressing cycles are performed a suitable number of times until the deformable members are plastically deformed by suitable amounts depending upon the dimensional and positional errors of the press, so as to assure substantially even distribution of the blank-holding force through the cushion pins. In the production run of the press performed after the test pressing cycles, the blanks can be held with the desired blank-holding force substantially evenly distributed over the entire area of the pressure member, even in the presence of the dimensional and positional errors of the press.

While the deformable members are more or less plastically deformed even in the production run of the press the amounts of the deformation of the deformable members are substantially the same because the force components transferred through the corresponding cushion pins are substantially the same. Therefore, the production run can be performed with substantially even distribution of the blank-holding force. As the cumulative amounts of deformation of the deformable members increase, the initial height of the pressure member prior to each pressing cycle decreases. Since the deformable members receive substantially the same force or load acting thereon, the amount of deformation of each deformable member caused by one pressing cycle is small. Thus, the deformable members can be used for a sufficiently large number of actual pressing cycles, which are started with the initial height of the pressure member set to be larger than the nominal value by a suitable amount.

As indicated above, the deformable members are disposed in appropriately selected ones of the transfer paths of the blank-holding force, in combination with the respective cushion pins, so that the blank-holding force is evenly distributed. The number and positions of the deformable members to be installed are suitably selected or determined depending upon the specific size and shape of the die set used. Accordingly, the present press is simpler in construction and less expensive than the conventional press equipped with balancing hydraulic cylinders whose oil chambers are connected to each other. Further, the deformable members may be applied to an existing press not equipped with any means for even distribution of the blank-holding force.

The deformable members may be fixed to a lower surface of the pressure member or an upper surface of the cushion pad. Alternatively, the deformable members are fixed to upper or lower ends of the plurality of cushion pins, respectively.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which:

FIG. 7 is a cross sectional view in enlargement of a portion of the press of FIG. 6 in which a deformable member is disposed;

FIG. 8 is a graph indicating a relationship between an average amount of deformation of the deformable member used in the press of FIG. 7 and the number of test pressing cycles performed on the press.

DETAILED DESCRIPTION OF THE PREFERRED EMBODIMENTS

Figure 1:
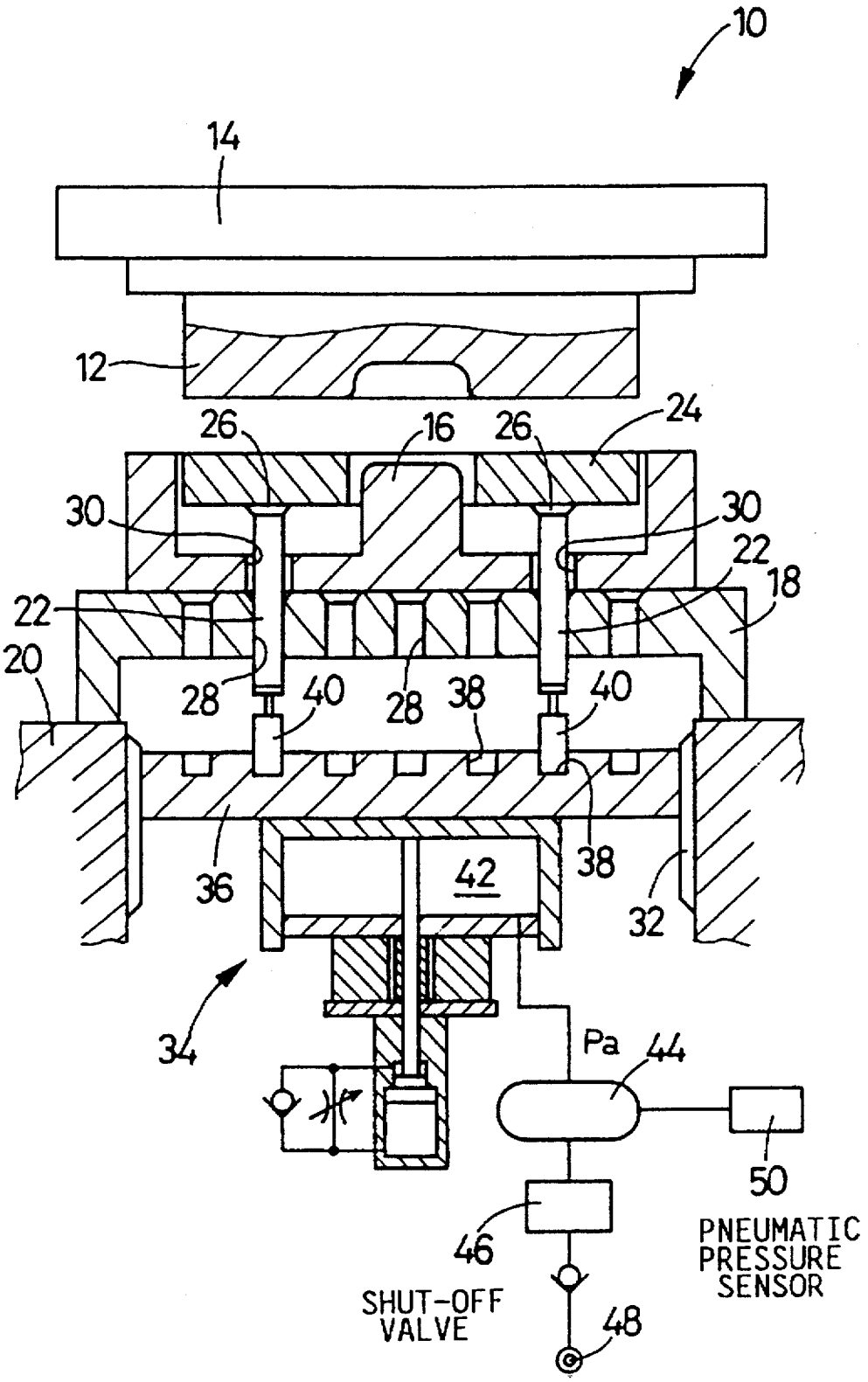
FIG. 1 is an elevational view in cross section showing a basic arrangement of one embodiment of a press of the present invention.

Referring first to FIG. 1 showing one embodiment of a press 10 adapted to effect a drawing operation on a blank to produce an other panel of a motor vehicle, for example, an upper die 12 is carried by a slide plate 14 which is vertically reciprocated by suitable drive means including a drive motor, a crankshaft, gears and links. On the other hand, a stationary bolster 18 to which a lower die in the form of a punch 16 is attached is positioned and fixed on a base 20, as shown in FIG. 1. During a setup operation of the press 10 in which the bolster 18 is located outside the press 10, the punch 16 is fixed to the bolster 18, and a plurality of cushion pins 22 are installed on the bolster 18 and the punch 16 while a pressure member in the form of a pressure ring 24 is placed on the upper ends of the cushion pins 22. The thus prepared assembly of the bolster 18, punch 16, cushion pins 22 and pressure ring 24 is fixed at a predetermined pressing position on the base 20. The bolster 18 has a plurality of through-holes 28 through which the respective cushion pins 22 extend. Each cushion pin 22 has a large-diameter upper end portion 26 which is engageable with the upper end portion of the corresponding through-hole 28, so that the cushion pin 22 is suspended from the bolster 18 when the bolster 18 is transported together with the cushion pins 22 during a setup procedure of the press 10, for example. The cushion pins 22 are provided to support the pressure ring 24 at their upper end portions 26, for applying a blank-holding force to the blank during a drawing operation on the blank.

The number and positions of the cushion pins 22 installed on the press 10 vary depending upon the specific configuration of a die set used, which consists of the upper die 12, punch 18 and pressure ring 24. In particular, the desired number and positions of the cushion pins 22 installed vary depending upon the shape and size of the pressure ring 24. For permitting drawing operations on various blanks using different die sets, the through-holes 28 are provided in a matrix form so as to cover a large area of the bolster 18. Namely, a large number of through-holes 28 are provided so that the through-holes 28 through which the installed cushion pins 22 extend are appropriately selected from among the many through-holes 28. The punch 16 has through-holes 30 corresponding to the cushion pins 30, which are to be used with the punch 16. The through-holes 30 have a diameter larger than that of the large-diameter end portion of the cushion pins 22. For example, the bolster 18 has as many as about 120 through-holes 28, while the punch 16 has about 20 to about 60 through-holes 30 for the cushion pins 22. That is, the number of the cushion pins 22 to be used for a drawing operation with a given pressure member 24 is not more than one half of the number of the through-holes 28 provided. The diameter of each through-hole 28 is selected to be slightly larger than the diameter of the cushion pins 22, so that the cushion pins 22 may be guided by the through-holes 28 during pressing cycles on the blanks.

Below the bolster 18 fixed at the predetermined pressing position on the base 20, there is disposed a cushion pad 36 which is guided by a guide 32 in the vertical direction and biased in the upward direction by a pneumatic cylinder 34, which constitutes a major part of force applying means for generating the blank-holding force to be applied to the blank through the cushion pad 36, cushion pins 22 and pressure ring 24. The cushion pad 36 has a plurality of recesses 38 formed in its upper surface. The recesses 38 are located right below the respective through-holes 28 of the bolster 18 installed in place. A plurality of mutually independent balancing gas cylinders 40 are fixed to the cushion pad 36 such that the lower portion of each gas cylinder 40 is fixedly received in the corresponding recess 40. Each gas cylinder 40 is gas-tightly charged or filled with a suitable gaseous fluid. During a setup procedure of the press 10 involving an exchange of die sets, the gas cylinders 40 are installed on the cushion pad 36 such that the gas cylinders 40 are aligned with the cushion pins 22, which are installed on the bolster 18 while the bolster 18 is located outside the press 10. When the cushion pad 36 is moved to its upper stroke end by the pneumatic cylinder 34 while the bolster 18 is installed in place on the press 10, the cushion pins 22 which are supported at their lower ends by the respective gas cylinders 40 as shown in FIG. 1 are moved up to thereby push up the pressure ring 24. The number of the gas cylinders 40 used for a given pressing operation with a given die set is the same as that of the cushion pins 22, and is usually selected within a range of about 20-60. The number of the gas cylinder 40 required for the press is the expected maximum number of the cushion pins 22 that are to be used with the largest die set. However, the gas cylinders 40 may be provided for all the recesses 38 provided on the cushion pad 36, irrespective of the specific numbers of the cushion pins 22 to be used for different pressing operations.

The pneumatic cylinder 34 has a pressure chamber 42 communicating with an air tank 44, which is connected to an air pressure source 48 in a factory, through a solenoid-operated shut-off valve 46. With the shut-off valve 46 suitably controlled, a pneumatic pressure Pa in the air tank 44 and pressure chamber 42 is adjusted as needed. The pneumatic cylinder 34, which constitutes a major part of the force applying means as described above, is adapted to apply to the cushion pad 36 a blank-holding force corresponding to the pneumatic pressure Pa when the cushion pad 36 is lowered by downward movements of the cushion pins 22 through the gas cylinders 40 as the upper die 12 is lowered in abutting contact with the pressure ring 24 through the blank. Consequently, the blank-holding force is transferred to the pressure ring 24 and blank through the gas cylinders 40 and cushion pins 22. A pneumatic pressure sensor 50 is provided to detect the pneumatic pressure Pa.

Each of the balancing gas cylinders 40 provided for the respective cushion pins 22 in the respective transfer paths of the blank-holding force (hereinafter referred to as "force transfer paths") has a cylinder housing 56 whose interior space is divided by two partition walls 52 into three mutually independent piston chambers 54 arranged in the axial or vertical direction. Within these three piston chambers 54, there are slidably received respective pistons 58. The gas cylinder 40 has a piston rod 62 which extends through the two partition walls 52 and an upper wall 60 of the cylinder housing 56. The piston rod 62 is connected integrally to the three pistons 58 so that the three pistons 58 are moved together in the direction in which the piston chambers 54 are arranged in spaced-apart relation. The piston rod 62 is connected at its upper end to a disc-like head 64, which is held in contact with the lower end of the corresponding cushion pin 22, when the gas cylinder 40 is installed in position on the press 10. The cylinder housing 56 has three through-holes 66 formed so as to communicate with upper sections of the respective piston chambers 54, so that the upper section of each piston chamber 54 on the upper side of the piston 58 communicates with the atmosphere and serves as an atmospheric chamber 73. The lower sections of the piston chambers 54 on the lower side of the pistons 58 serve as gas chambers 74. Thus, each piston chamber 54 is divided by the piston 58 into the atmospheric chamber 73 and the gas chamber 74. The gas chambers 74 communicate with each other through an axial center hole 68 and two radial communication holes 70, 70 that are formed through the piston rod 62. The axial center hole 70 is open at its lower end to the lowermost gas chamber 74 and is closed at its upper end by the uppermost piston 58. On the other hand, the two radial communication holes 70 which communicate with the axial center hole 70 are formed adjacent the uppermost and intermediate pistons 58 and communicate with the uppermost and intermediate gas chambers 74. The lowermost gas chamber 74 is partly defined by a lower wall 72 of the cylinder housing 56, which has a filler port 76 for filling the gas chambers 74 with a suitable gaseous fluid such as nitrogen gas. Upon filling the gas chambers 74, a nozzle connected to a gas supply source is connected to the filler port 76. Normally, the filler port 76 is gas-tightly closed.

In each balancing gas cylinder 40 constructed as described above, a total load or force f which acts on the piston rod 62 in the upward direction is represented by the following equation:

$$f=3S.Pg$$

where,

S=pressure-receiving area of each piston 58,

Pg=pressure of the gas filling the gas chambers 74.

Figure 3:
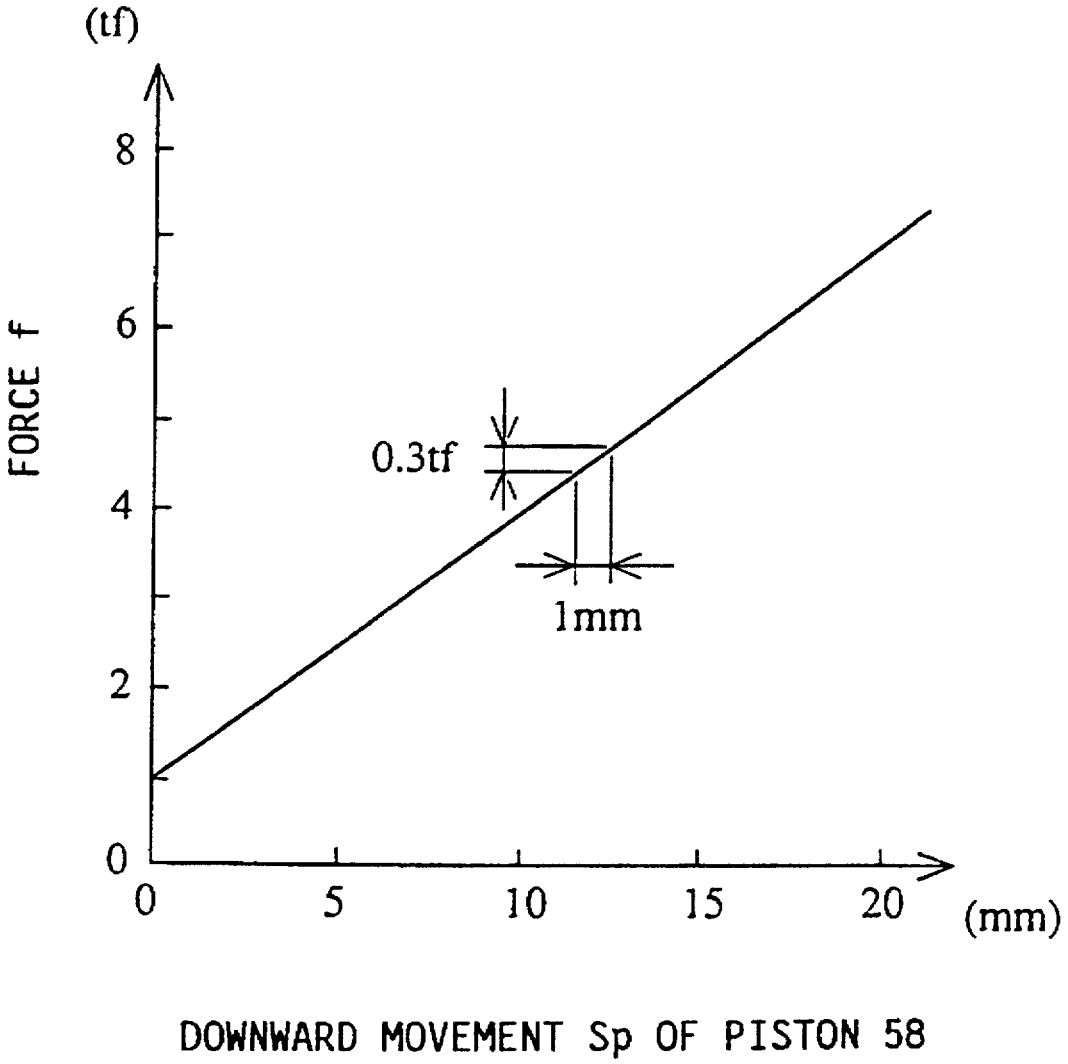
FIG. 3 is a graph indicating a relationship between a force generated by the gas cylinder of FIG. 2 and an operating stroke of the piston of the gas cylinder.

The force f increases linearly with an increase in the gas pressure Pg in the gas chambers 74 as the pistons 58 are pushed down so as to reduce a volume V of the gas chambers 74. An example of the linear increase of the force f in relation to downward movement distance Sp of the pistons 58 is shown in the graph of FIG. 3. In this graph, the force f is represented in unit tf, which is approximately equal to $9.8\times10^3$N.

Figure 2:
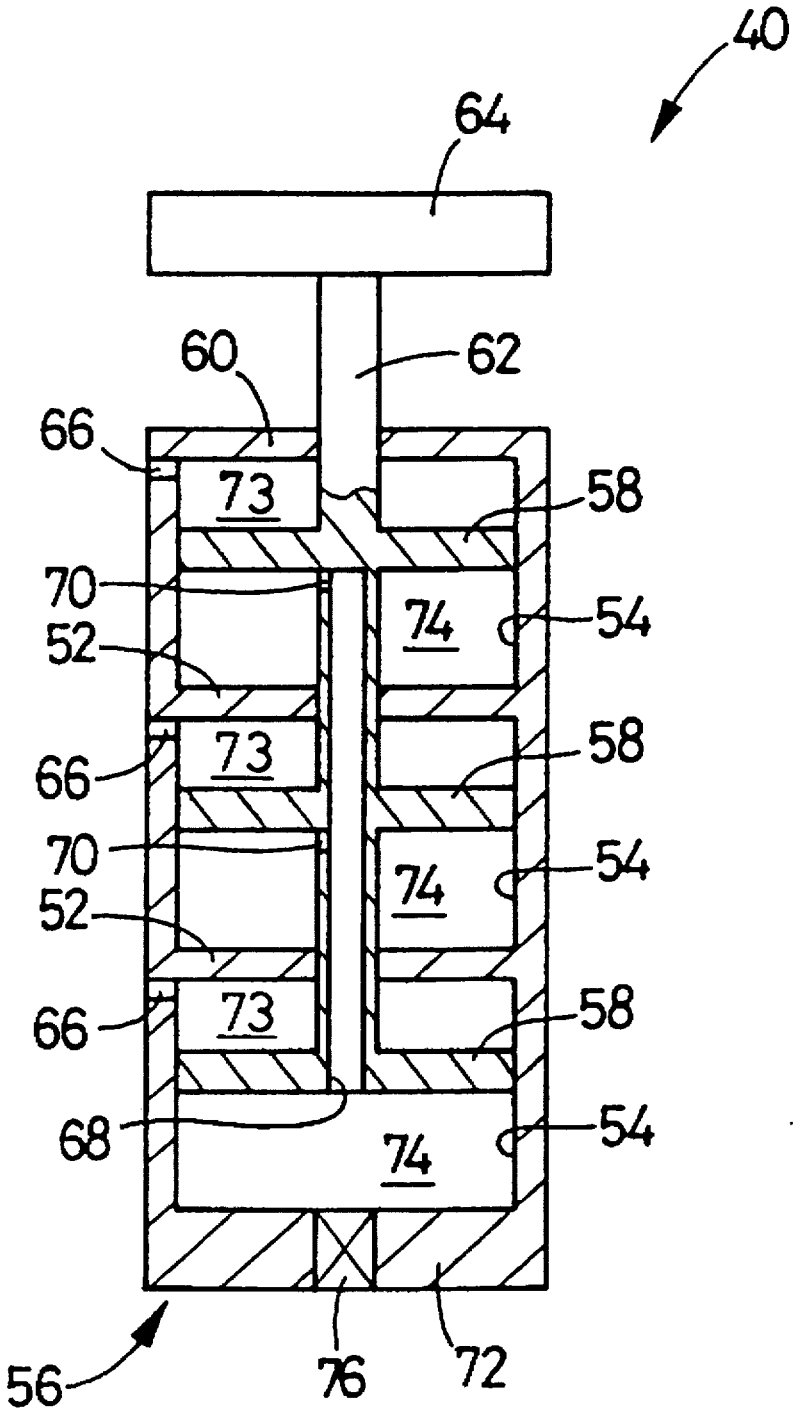
FIG. 2 is an elevational view in cross section of an example of a balancing gas cylinder used in the embodiment of FIG. 1.

In FIG. 2, the cylinder housing 56 is shown as a one-piece body, and the pistons 58 and piston rod 62 are shown as an integral body. In fact, however, the cylinder housing 56 consists of a plurality of members connected to each other, while the pistons 58 are fixed to the piston rod 62 so as to form a unitary member. Although the axial center hole 68 and radial communication holes 74 are provided for mutual communication of the three gas chambers 70, the gas cylinder 40 may use other suitable means for the communication, such as a passage or passages formed in the cylindrical wall of the cylinder housing 56.

In the press 10 constructed as described above, the mutually independent gas chambers 40 filled with the suitable gaseous fluid are disposed in the respective force transfer paths corresponding to the individual cushion pins 22, more precisely, between the cushion pad 36 and the lower end of each cushion pin 22. In operation of the press 10 in which the pistons 58 of the gas cylinders 40 are pushed down by the piston rod 62, the blank-holding force produced by the pneumatic cylinder 34 is transferred to the cushion pins 22 through the compressed gas (having the pressure Pg) in the gas chambers 74. The downward movement distance Sp of the pistons 58 of one gas cylinders 40 may differ from that of another gas cylinder 40, due to dimensional and positional errors of the press such as inclination of the cushion pad 36 and slide plate 14 and dimensional variations of the cushion pins 22 and pressure ring 24 from the nominal values. Accordingly, the gas pressure Pg in each gas cylinder 40 and the corresponding force f may differ from those of another gas cylinder 40. In other words, the force f produced by each gas cylinder 40 may have a variation from the nominal value due to a variation of the movement distance Sp from the nominal value. However, the f-Sp characteristics of the gas cylinders 40, more specifically, the relationships between the downward movement distance Sp of the pistons 58 and the force f of each gas cylinder 40 can be comparatively freely or easily determined or controlled by suitably determining the initial gas pressure Pg, the pressure-receiving area S, and the volume V of the gas chambers 74 when the piston 58 is at at its upper stroke end. Therefore, it is possible to reduce the amount of variation of the forces f due to the different downward movement distances Sp of the individual gas cylinders 40, to within a permissible range that does not cause a significant influence on the distribution of the blank-holding force on the pressure ring 24, or a significant influence on the quality of the products obtained from the blanks. In other words, the gas cylinders 40 permit substantially even distribution of the blank-holding force to the cushion pins 22, which are arranged so as to meet the specific configuration of the die set including the pressure ring 24.

Explained in detail, the variation of the force f of each balancing gas cylinder 40 due to the variation of the movement distance Sp can be held to within the permissible range, by reducing a ratio f/Sp down to a level Y/X (tf/mm) or lower, where X represents the variation (unit: mm) of the movement distance Sp due to the inclination of the cushion pad 36 and slide plate 14 and the dimensional variations of the cushion pins 22 and pressure ring 24, while Y represents a tolerance (unit: tf) of the variation of the force f. Thus, the blank-holding force can be substantially evenly distributed over the entire area of the pressure ring 24 through the cushion pins 22. Where the variation X of the movement distance Sp is about 1 mm and the tolerance Y of the variation of the force f is about 1 tf, the ratio f/Sp should be reduced to 1 (tf/mm) or lower. For instance, the linear change of the force f with an increase in the downward movement distance Sp of the pistons 58 as shown in FIG. 3 is satisfactory, since the ratio f/Sp is about 0.3 (tf/mm). The ratio f/Sp increases with an increase in the initial gas pressure Pg or a decrease in the volume V relative to the pressure-receiving area S. That is, the ratio f/Sp can be reduced by lowering the initial gas pressure Pg or increasing the ratio V/S.

It is also noted that the desired force f which acts on one cushion pin 22 varies depending upon the kind of the die set used and the total number of the cushion pins 22 used. For using the same set of gas cylinders 40 for different die sets and with different numbers of the cushion pins 22, the f-Sp characteristics of each gas cylinder 40 must be determined so that the force f can be changed over the entire operating range within which the press is expected to operate with the various die sets. Where the required operating range of the force f is from 1.5 (tf) to 7 (tf) as indicated in FIG. 3, for example, it is required that the force f can be changed over the entire range of 1.5–7 (tf), while maintaining the downward movement distance Sp of the pistons 58 below the upper limit, which is the maximum distance Sp from their initial position of the pistons 58. In this connection, it is noted that the distance Sp of the pistons 58 required to obtain the desired force f increases as the ratio f/Sp decreases. That is, where the desired force f is relatively large, the required distance Sp of the pistons 58 is accordingly large, requiring a relatively large operating stroke of the pressure ring 24, which in turn requires the pressure ring 24 to have a relatively large initial height. An increase in the initial height of the pressure ring 24 means a decrease in the time duration during which the upper die 12 is separated or spaced from the pressure ring 24 during each pressing cycle. Thus, increasing the initial height of the pressure ring 24 tends to result in difficult loading of the blanks and unloading of the products.

It will therefore be understood that the f-Sp characteristics of the balancing gas cylinders 40 should be determined so as to able to change the force f over the entire operating range with a movement distance Sp of the pistons 58 held below the upper limit (nominal maximum stroke), while at the same time maintaining the ratio f/Sp below the upper limit Y/X.

In determining the f-Sp characteristic of each gas cylinder 40, it is noted that the force f can be increased by increasing the initial gas pressure Pg in the gas chambers 74 and/or the pressure-receiving area S of the pistons 58. However, there is a limitation in the maximum gas pressure Pg. Where the gaseous fluid is a nitrogen gas, for example, the maximum permissible gas pressure Pg is 150 $kgf/cm^2$ ($=150\times9.8\times10^4$ Pa). On the other hand, the diameter of the gas cylinder 40 increases with an increase in the pressure-receiving area S. Accordingly, the number of the cushion pins 22 that can be installed on the press 10 in the desired pattern tends to be reduced as the pressure-receiving area S is increased. The present gas cylinder 40 has the three gas chambers 74 which are spaced from each other in the axial or vertical direction, so that the total pressure-receiving area of the gas cylinder 40 is three times the pressure-receiving area S of each piston 58. This arrangement makes it possible to determine the initial gap pressure Pg and/or pressure-receiving area S so as to obtain a suobtain a sufficiently large force f, while maintaining the diameter of the gas cylinder 40 at a relatively small value within a range of about 40–60 mm and maintaining the gas pressure Pg below the maximum permissible level. Thus, the desired force f can be obtained without considerably increasing the required installation space for the gas cylinders 40. Thus, the cushion pins 22 and gas cylinders 40 can be arranged in the desired pattern without a significant restriction by the diameter of the gas cylinders 40, for example, in substantially the same pattern in which the conventional balancing hydraulic cylinders are arranged. Accordingly, the distribution of the blank-holding force to the cushion pins 22 can be intricately controlled while at the same time the desired f-Sp characteristics or relationships as indicated in FIG. 3 can be obtained. The nominal operating range over which the total force f produced by the gas cylinders 40 can be changed is suitably determined depending upon the number of the cushion pins 22 or gas cylinders 40. Although the gas cylinder 40 has the three gas chambers 74 (three piston chambers 54), the number of the gas chambers 74 as well as the pressure-receiving area S, volume V of the gas chambers 74 and initial gas pressure Pg may be determined as needed.

As described above, the press 10 of the present embodiment of this invention has the mutually independent balancing gas cylinders 40 charged with a gaseous fluid. The gas cylinders 40 are disposed on the cushion pad 36, in combination with the respective cushion pins 22 in the respective transfer paths of the blank-holding force, so that the blank-holding force is evenly distributed over the entire area of the pressure ring 24 through the cushion pins 22. The present arrangement permits the desired number of the gas cylinders 40 to be disposed at the desired positions. That is, the presently installed gas cylinders 40 can be moved to the other positions on the cushion pad 36, or removed from the cushion pad 36, and/or the other gas cylinders 40 can be newly installed at the desired positions, depending upon the specific configuration of the die set, in particular, the specific shape and size of the pressure ring 24. Further, the number of the gas cylinders 40 that should be prepared to deal with the pressing operations with the intended various kinds of die sets is equal to the maximum number of the gas cylinders which are to be actually used with the largest die set. Consequently, the press 10 using the balancing pneumatic cylinders 40 is simpler in construction and less costly than a conventional press equipped with multiple balancing hydraulic cylinders which are permanently installed at the predetermined positions and whose oil chambers are connected to each other. The present gas cylinders 40 may be easily applied to an existing press not equipped with any balancing means for even distribution of the blank-holding force.

As mentioned above, each balancing gas cylinder 40 has a plurality of piston chambers 54 (gas chambers 74) which are arranged in the axial direction (in which the piston rod 62 is moved). This arrangement permits the gas cylinder 40 to produce a sufficiently large force f while maintaining the diameter of the gas cylinder 40 at a relatively small value and maintaining the gas pressure Pg below the permissible upper limit. Accordingly, the required total installation space for the gas cylinders 40 can be made relatively small, and the cushion pins 22 and the gas cylinders 40 can be installed in substantially the same pattern (number and location) as the conventional balancing hydraulic cylinders, for even distribution of the blank-holding force.

Further, the f-Sp characteristic of each balancing gas cylinder 40 used in the present embodiment is determined so that a sum of the forces f produced by all of the gas cylinders 40, that is, the blank-holding force, can be changed depending upon the specific configuration of the die set used. Thus, all of the pressing operations intended to be performed can be dealt with by using selected ones of the same set of the gas cylinders 40. That is, it is not necessary to prepare different sets of gas cylinders 40 corresponding to respective die sets, or to adjust the initial gas pressure Pg in each gas cylinder 40. Accordingly, the cost required for preparing and storing the gas cylinders 40 can be reduced, and the setup of the press 10 upon changing of the die set from one to another is facilitated. In this respect, a conventional press equipped with multiple balancing hydraulic cylinders which communicate with each other requires adjustment of the initial hydraulic pressure in the hydraulic cylinders so as to hold the pistons at their neutral position during a pressing cycle, depending upon the desired blank-holding force and the number of the cushion pins used, which are determined by the specific die set used.

Figure 4:
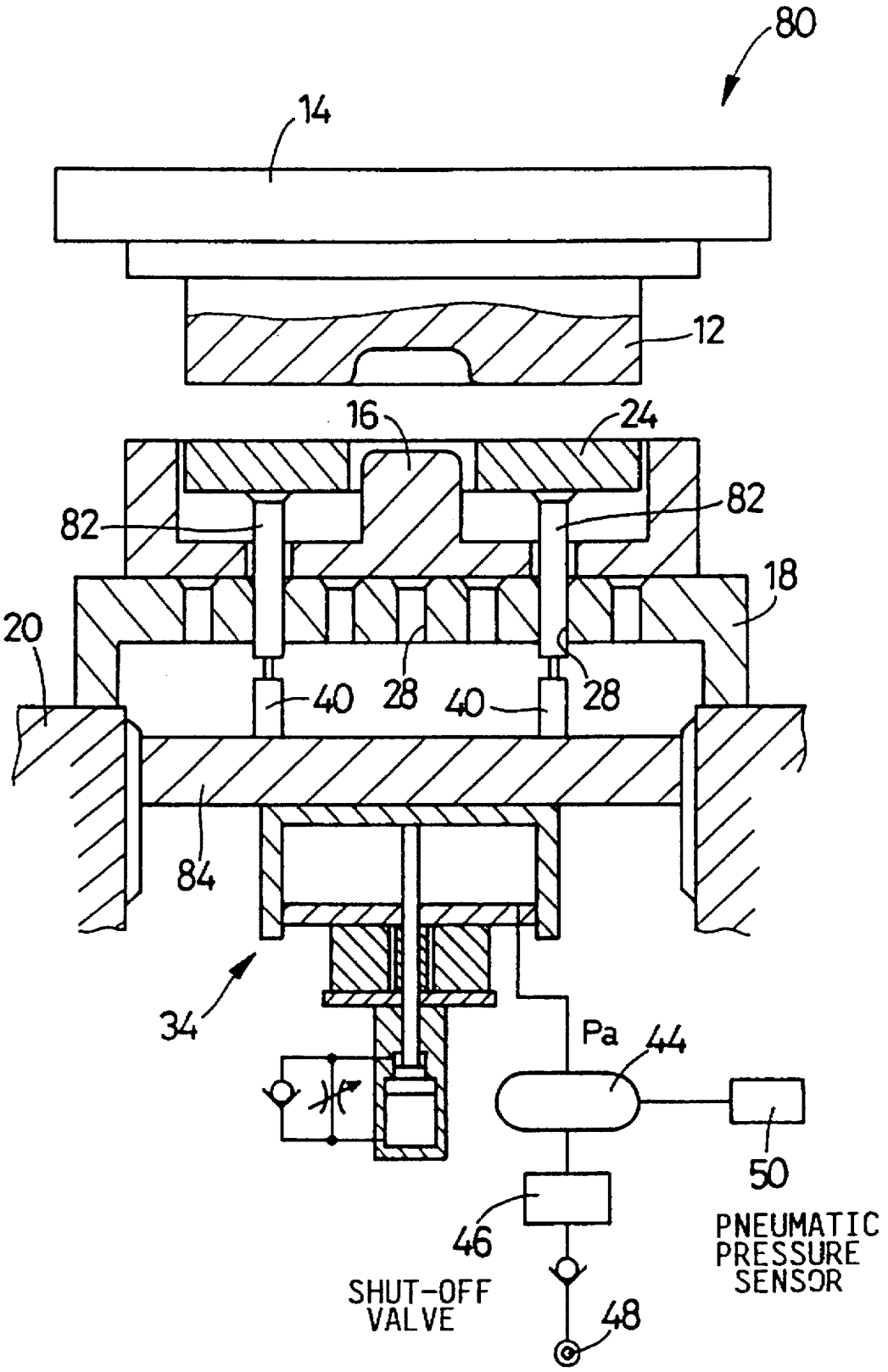
FIG. 4 is a cross sectional view of a press according to another embodiment of this invention.

Referring next to FIG. 4, there will be described a press 80 constructed according to a second embodiment of this invention. The press 80 uses cushion pins 82 similar to the cushion pins 22 used in the first embodiment. However, the cushion pins 82 are physically connected to the respective gas cylinders 40. Explained more particularly, the piston rod 62 extending upward from the cylinder housing 56 of each gas cylinder 40 as shown in FIG. 2 is fixed or connected to the corresponding cushion pin 82, or the piston rod 62 and the cushion pin 82 are formed as an integral body. In this case, the gas cylinders 40 can be positioned on a cushion pad 84 when the bolster 18 is positioned relative to the base 20. During the setup procedure of the press 10 involving the exchange of the die sets, each cushion pin 82 with the gas cylinder 40 attached thereto is inserted through the corresponding through-hole 28 in the bolster 18, and the gas cylinders 40 are automatically positioned relative to the cushion pad 84 by simply positioning the bolster 18. Thus, the setup can be effected with higher efficiency in the present second embodiment than in the first embodiment which requires separate positioning of the gas cylinders 40 in partial engagement with the respective recesses 38, independently of the installation of the cushion pins 22 on the bolster 18. The elimination of the recesses 38 and the separate positioning of the gas cylinders 40 facilitate the application of the gas cylinders 40 to an existing press not equipped with any balancing cylinders. The cylinder housing 56 of each gas cylinder 40 has an outside diameter substantially equal to or slightly smaller than the diameter of the through-hole 28 formed through the bolster 18, so that the gas cylinder 40 may pass through the through-hole 28 to permit the insertion of the cushion pin 82 therethrough when the assembly of the cushion pin 82 and gas cylinder 40 is installed on the bolster 18 with the cushion pin 82 extending through the through-hole 28. Thus, the outside diameter of the gas cylinders 40 is not larger than that of the cushion pins 82, so that the gas cylinders 40 can pass through the through-holes 28 together with the cushion pins 82. Although the gas cylinder 40 is provided at the lower end of the cushion pin 82, it may be provided at the upper end of the cushion pin 82, or interposed between the upper and lower portions of the cushion pins 82.

A press 90 according to a third embodiment of the invention will be described by reference to FIG. 5.

While the presses 10 and 80 of the first and second embodiments are adapted such that the cushion pins 22, 82 are suspended from the bolster 18 when the bolster 18 is transported together with the punch 26 and cushion pins 22, 82, the press 90 of the present third embodiment is adapted such that the cushion pins 82 are suspended from the lower die in the form of a punch 94 when a bolster 92 is transported. The punch 94 has a base portion 96 having a larger wall thickness than the base portion of the punch 16 used on the presses 10, 80. The base portion 96 has through-holes 98. Like the through-holes 28 formed in the bolster 18 in the preceding embodiments, each through-hole 98 has a diameter slightly larger than the diameter of the cushion pins 82. The through-holes 98 function to guide the cushion pins 82 during a pressing cycle. Each cushion pin 82 has a large-diameter upper end 100 which is engageable with the edge of the upper open end of the corresponding through-hole 98, so that the cushion pin 82 is suspended from the punch 94 when the bolster 92 is moved together with the punch 94 and cushion pins 82, during setup of the press 90, for example. Unlike the bolster 18 which has the through-holes 28, the bolster 92 has a relatively large cutout 102 at a portion thereof which correspond to the portion of the bolster 18 in which the through-holes 28 are formed. The size of the cutout 102 is determined so that the all the cushion pins 82 intended to be used with any of the die sets to be used can extend through the cutout 102 from the punch 94, such that the corresponding gas cylinders 40 carried at the lower ends of the cushion pins 82 are placed on the cushion pad 84.

In the press 90 of the present third embodiment, the positions of the through-holes 98 formed in the base portion 96 of the punch 94, namely, the positions of the cushion pins 82 are not restricted by the bolster 18, and can be selected as needed depending upon the die set used. The present arrangement is advantageous particularly when the pressure ring 24 has a relatively small size. In this case, the punch 94 is formed such that the through-holes 98 are arranged with comparatively small spacings between the adjacent through-holes 90 so that the cushion pins 82 are disposed at optimum positions for even distribution of the blank-holding force over the entire area of the pressure ring 24. In the presses 10, 80 of the first and second embodiments, however, the positions of the cushion pins 22, 82 are determined by the positions of the through-holes 28 formed through the bolster 18, and the through-holes formed through the punch 16 should be aligned with the through-holes 28. This means that it is impossible to use the punch 16 in which the spacings between the adjacent through-holes are smaller than those of the through-holes 28 in the bolster 18. Therefore, the cushion pins 22, 82 cannot be disposed at the best positions, and the blank-holding force may not be evenly distributed over the entire area of the pressure ring 24 when the size of the pressure ring 24 is relatively small. This is also true for the cushion pins linked with the conventional balancing hydraulic cylinders whose oil chambers communicate with each other.

Figure 6:
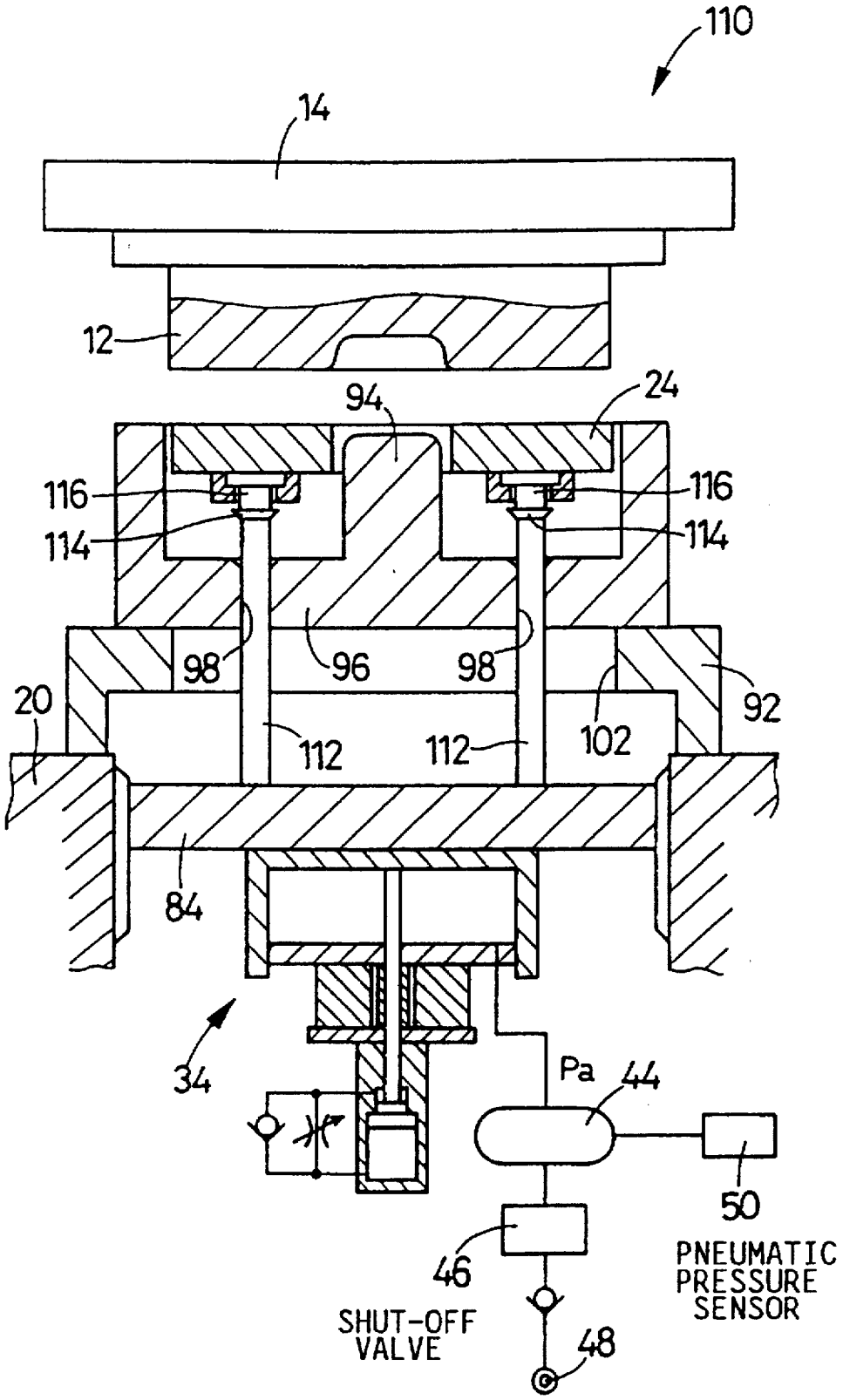
FIG. 6 is a cross sectional view of a press according to a still further embodiment of the invention.

Referring next to FIG. 6, there is shown a press 110 according to a fourth embodiment of the present invention, which is not provided with the gas cylinders 40. That is, the press 110 use cushion pins 112, and deformable members 116 disposed in respective transfer paths of the blank-holding force corresponding to the respective cushion pins 112. More specifically described, the deformable members 116 are interposed between the lower surface of the pressure ring 24 and large-diameter end portions 114 of the respective cushion pins 114. Each deformable member 116 is plastically deformable by the force transferred from the corresponding cushion pin 112 during a pressing cycle.

Each deformable member 116 is a stepped solid cylindrical member consisting of a large-diameter portion 118 and a small diameter portion 120. The deformable member 116 is fixed to the pressure ring 24 by a holder 122 such that the large-diameter portion 118 is held in close contact with the lower surface of the pressure ring 24 while there is left an annular clearance between the inner circumferential surface of the holder 122 and the outer circumferential surface of the small-diameter portion 120. This annular clearance permits radial expansion or an increase in the diameter of the small-diameter portion 120 due to plastic compression thereof in the axial direction. That is, only the small-diameter portion 120 is plastically deformable by the load applied thereto during a pressing operation on the press 110. The punch 94 used on the press 110 has a height dimension from the base portion 96, which dimension is larger than that of the punch 94 used on the press 90, by an amount equal to the height of the deformable members 116. The initial height of the pressure ring 24 is accordingly increased.

In the press 110, forces transferred by the individual cushion pins 112 to the pressure ring 24 initially differ from each other due to dimensional and positional errors of the press such as the inclination of the slide plate 14 and cushion pad 84 and the dimensional variations of the cushion pins 112 and pressure ring 24 from the nominal values. As the pressing operation is repeatedly performed, the deformable members 116 are plastically deformed by different amounts depending upon the different forces applied through the respective cushion pins 112. The different amounts of plastic deformation of the deformable members 116 absorb or accommodate the dimensional and positional errors of the press 110, so that the forces or loads transferred through the individual cushion pins 112 to the pressure ring 24 are made substantially equal to each other, whereby the blank-holding force is substantially evenly distributed over the entire area of the pressure ring 24 through the cushion pins 112 (and the deformable members 116). The dimensional errors may be different lengths of the cushion pins 112, for example. If a certain cushion pin 112 is relatively long, the force transferred through this cushion pin 112 is relatively large, and the corresponding deformable member 116 undergoes a relatively large amount of plastic deformation. If another cushion pin 112 is relatively short, on the other hand, the force transferred through a relatively short cushion pin 112, is relatively small, and the corresponding deformable member 116 undergoes a relatively small amount of plastic deformation. Eventually, the difference of the amounts of deformation of these two cushion pins 112 becomes equal to the difference of the lengths of the two cushion pins 112, whereby the forces transferred to the pressure ring 24 through these two cushion pins 112 are made substantially equal to each other.

Therefore, prior to an actual pressing operation, the deformable members 116 should be deformed by respective amounts suitable for even distribution of the blank-holding force through the cushion pins 112. To this end, test pressing cycles should be performed a suitable number of times until the deformable members 116 are deformed for substantially even distribution of the blank-holding force. In a production run of the press 110 performed after the test pressing cycles, the blanks can be suitably held with substantially even distribution of the blank-holding force over the entire area of the pressure ring 24, even in the presence of the dimensional and positional errors of the press.

Although the deformable members 116 are more or less plastically deformed even in the production run of the press 110, the amounts of the deformation of the deformable members 116 are substantially the same because the forces transferred through the corresponding cushion pins 112 are substantially the same. Therefore, the production run can be performed with substantially even distribution of the blank-holding force. As the cumulative amounts of deformation of the deformable members 116 increase, the initial height of the pressure ring 24 (prior to a pressing cycle) decreases. Since the deformable members 116 receive substantially the same force or load acting thereon, the amount of deformation of each deformable member 116 caused by one pressing cycle is small. A practically sufficient number of production pressing cycles is possible by starting the production with the initial height of the pressure ring 24 set to be larger than the nominal value by a suitable amount. When the initial height of the pressure ring 24 is reduced below a predetermined lower limit due to the gradual increase of the deformation amounts of the deformable members 116, these deformable members 116 are replaced by new ones, and the test pressing cycles are effected with the new deformable members 116 before a production run of the press 110 is resumed with the new deformable members 116.

An optimum number of the test pressing cycles with the new deformable members 116 for assuring even distribution of the blank-holding force may be determined by observing the quality of the products obtained by the test pressing cycles, or determined empirically or on the basis of experimental data. Alternatively, the optimum number may be obtained according to theoretical formulas as explained below. The following parameters or values are used in the following equations (1), (2) and (3):

- L: initial length of the small-diameter portion 120 of each deformable member 116, prior to deformation,
- m: number of test pressing cycles
- $dL_i$: cumulative amount of deformation of the small-diameter portion 120 after the "m" number of test pressing cycles
- $\epsilon_{im}$: cumulative strain of the small-diameter portion 120 after the "m" number of test pressing cycles
- $L_{xi}$: target length of the small-diameter portion 120 per one test pressing cycle
- $dL_{xi}$: amount of deformation of the small-diameter portion 120 per one test pressing cycle
- $e_{xi}$: strain of the small-diameter portion 120 per one test pressing cycle
- n: number of the deformable members 116 (cushion pins (112)
- $e_{ti}$: dLi/L
- $e_{ij}$: strain of the small-diameter portion 120 for each test pressing cycle
- i: 1, 2, . . . n
- j: 1, 2, . . . m The following equation (1) represents a relationship among the values $L_{xi}$, $dL_{xi}$ and $e_{xi}$:

$$e_{xi}=dL_{xi}/L_{xi} \tag{1}$$

Therefore, the cumulative strain $\epsilon_{im}$ of the small-diameter portion 120 after the test pressing cycles are preformed the "m" number of times is represented by the following equation (2):

$$\epsilon_{im}=\int_{L}^{L+dL_i} e_{xi}=\int_{L}^{L+dL_i}(dL_{xi}/L_{xi})=\log(1+e_{ti})\approx e_{ti}-\frac{e_{ti}^2}{2}+\frac{e_{ti}^3}{3}-\frac{e_{ti}^4}{4} \tag{2}$$

As indicated above, the value $e_{ti}$ appearing in the above equation (2) is equal to the cumulative deformation amount $dL_i$ of the small-diameter portion 120 divided by the initial length L. Where the cumulative deformation amount dLi is small, the cumulative strain $\epsilon_{im}$ is almost equal to the value $e_{ti}=dL_i/L$. Since the cumulative strain $\epsilon_{im}$ is a sum of the strain values $e_{ij}$ obtained in the "m" number of test pressing cycle (j=1, 2, . . . m), it is represented by the following equation (3):

$$\epsilon_{im}=\sum_{j=1}^{m} e_{ij} \tag{3}$$

The following values are also used in the following equations (4) through (19):

- $dL_{av}$: average deformation amount of the small-diameter portions 120 of all ("n") of the deformable members 116 after the "m" number of test pressing cycles
- E: vertical plastic deformation coefficient of the small-diameter portion 120 (determined by approximation by linear interpolation)
- $s_{ij}$: stress
- $f_{ij}$: force transferred to the deformable member 116
- $S_{ij}$: pressure-receiving (cross sectional) area of the small-diameter portion 120
- So: pressure-receiving area of the small-diameter portion 120 prior to the deformation
- $\nu_{ij}$: Poisson's ratio of the small-diameter portion 120
- $S_{im}$: pressure-receiving area of the small-diameter portion 120 after the "m" number of test pressing cycles
- F: blank-holding force acting on the pressure ring 24

The average deformation amount $dL_{av}$ of the small-diameter portions 120 of all the deformable members 116 (number of the members 116 ="n") after the test pressing cycles are performed by the "m" number of times is equal to the sum of the cumulative deformation amounts $dL_i$ of the individual small-diameter portions 120 divided by the number "n". Therefore, the following equation (4) is satisfied:

$$\sum_{i=1}^{n} dL_i = n \cdot dL_{av} \tag{4}$$

Since the cumulative strain $\epsilon_{im}$ is equal to $e_{ti}=dL_i/L$ where the cumulative deformation amount $dL_i$, the sum of the cumulative strain values $\epsilon_{im}$ of all ("n") the deformable members 116 is represented by the following equation (5):

$$\sum_{i=1}^{n} \epsilon_{im} = \sum_{i=1}^{n} \frac{dL_i}{L} \tag{5}$$

Further, the strain $e_{ij}$ of each deformable member 116 after the "j" times of test pressing cycles is represented by the following equation (6):

$$e_{ij} = \frac{\sigma_{ij}}{E} = \frac{f_{ij}}{E \cdot S_{ij}} \tag{6}$$

In this case, a relationship between the pressure-receiving areas (cross sectional area) $S_{ij}$ and So of the small-diameter portion 120 is represented by the following equation (7), assuming that the pressure-receiving area is proportional to $(1-\nu_{ij})$ as in the case of elastic deformation:

$$S_{ij} = (1-\nu_{ij})^{-j} \cdot S_0 = \frac{S_0}{(1-\nu_{ij})^j} \tag{7}$$

The pressure-receiving area $S_{im}$ of the small-diameter portion 120 after the "m" number of test pressing cycles is represented by the following equation (8):

$$S_{im} = \sum_{j=1}^{m} \frac{S_0}{(1-\nu_{ij})^j} = S_0 \sum_{j=1}^{m} \left(\frac{S_0}{1-\nu_{ij}}\right)^j \tag{8}$$

Suppose the right member of the equation (8) is represented by So.A, and the value $1/(1-\nu_{ij})$ is replaced by "a", the following equation (10) representing the value "A" is obtained from the following equation (9), and the pressure-receiving area $S_{im}$ is represented by the following equation (11):

$$\frac{A = a + a^2 + a^3 + \ldots a^m - aA = a^2 + a^3 + \ldots a^m + a^{m+1}}{(1-a)A = a - a^{m+1} = a(1-a^m)} \tag{9}$$

$$A = \frac{a(1-a^m)}{1-a} = \frac{\frac{1}{1-\nu_{ij}} \cdot \left\{1-\left(\frac{1}{1-\nu_{ij}}\right)^m\right\}}{1-\left(1-\frac{1}{\nu_{ij}}\right)} = \frac{\nu_{ij}}{1-\nu_{ij}} \cdot \left\{1-\left(\frac{1}{1-\nu_{ij}}\right)^m\right\} \tag{10}$$

$$S_{im} = S_0 \cdot \frac{\nu_{ij}}{1-\nu_{ij}} \cdot \left\{1-\left(\frac{1}{1-\nu_{ij}}\right)^m\right\} \tag{11}$$

On the other hand, the following equation (12) which represents the sum of the cumulative strain values $\epsilon_{im}$ after the "m" number of test pressing cycles of each deformable member 116 is obtained from the above equations (3), (4) and (5), and the following equation (13) is obtained from the above equation (6):

$$\sum_{i=1}^{n}\sum_{j=1}^{m} e_{ij} = \sum_{i=1}^{n} \epsilon_{im} = \sum_{i=1}^{n} \frac{dL_i}{L} = \frac{n \cdot dL_{av}}{L} \tag{12}$$

-continued $$\sum_{i=1}^{n}\sum_{j=1}^{m} e_{ij} = \sum_{i=1}^{n}\left(\sum_{j=1}^{m} \frac{f_{ij}}{E \cdot S_{ij}}\right) = \frac{1}{E} \cdot \sum_{i=1}^{n}\left\{\left(\sum_{j=1}^{m} f_{ij}\right)\left(\sum_{j=1}^{m} \frac{1}{S_{ij}}\right)\right\} = \frac{1}{E} \cdot \left(\sum_{i=1}^{n}\sum_{j=1}^{m} f_{ij}\right) \cdot \left\{\sum_{i=1}^{n}\sum_{j=1}^{m}\left(\frac{1}{S_{ij}}\right)\right\} \tag{13}$$

The following equation (15) representing the pressure-receiving area $S_{im}$ is obtained from the following equation (14). Further, since the following equation (16) is obtained from the above equation (11), the above equation (13) can be converted into the following equation (17). The following equation (18) is obtained from this equation (17) and the above equation (12), and the following equation (19) is obtained assuming that the Poisson's ratio $\nu_{ij}$ is constant:

$$\sum_{i=1}^{n}\sum_{j=1}^{m} f_{ij} = mF \tag{14}$$

$$S_{im} = \sum_{j=1}^{m} S_{ij} \tag{15}$$

$$\sum_{j=1}^{m} \frac{1}{S_{ij}} = \frac{1}{S_0} \cdot \frac{1-\nu_{ij}}{\nu_{ij}} \cdot \left\{1-\left(\frac{1}{1-\nu_{ij}}\right)^m\right\}^{-1} \tag{16}$$

$$\sum_{i=1}^{n}\sum_{j=1}^{m} e_{ij} = \frac{1}{E} \cdot mF \cdot \sum_{i=1}^{n}\left[\frac{1}{S_0} \cdot \frac{1-\nu_{ij}}{\nu_{ij}} \cdot \left\{1-\left(\frac{1}{1-\nu_{ij}}\right)^m\right\}^{-1}\right] \tag{17}$$

$$\frac{n \cdot dL_{av}}{L} = \frac{1}{E} \cdot mF \cdot \frac{n(n+1)}{2} \times \frac{1}{S_0} \cdot \frac{1-\nu_{ij}}{\nu_{ij}} \cdot \left\{1-\left(\frac{1}{1-\nu_{ij}}\right)^m\right\}^{-1} \tag{18}$$

$$\frac{n \cdot dL_{av}}{L} = \frac{1}{E} \cdot mF \cdot \frac{n(n+1)}{2} \times \frac{1}{S_0} \cdot \frac{1-\nu}{\nu} \cdot \left\{1-\left(\frac{1}{1-\nu}\right)^m\right\}^{-1} \tag{19}$$

The relationship between the number "m" of test pressing cycles and the average deformation amount $dL_{av}$ can be obtained by inserting in the above equation (19) actual values of the following parameters as the actual operating condition of the press 110: number "n" of the cushion pins 112 used); blank-holding force F; cross sectional area So of the small-diameter portion 120 of each deformable member 116; length L of the small-diameter portion 120; and vertical plastic deformation coefficient E and Poisson's ratio ν as the mechanical properties of each deformable member 116. An example of the thus obtained m-$dL_{av}$ relationship is indicated in the graph of FIG. 8, wherein X represents a critical value of the average deformation amount $dL_{av}$ at which gaps between the deformable members 116 and the upper ends of the cushion pins 112 are substantially zeroed for all the cushion pins 112, while M represents the number of the test pressing cycles which corresponds to the critical value X. The critical value X can be obtained on the basis of a distribution of the above-indicated gaps which are caused by the dimensional and positional errors of the press 110 described above. Namely, the gaps between all the deformable members 112 and the corresponding cushion pins 112 can be eliminated by performing the test pressing cycles the "M" number of times. Thus, the test pressing cycles make it possible to establish the optimum operating condition of the press 110 that assures substantially even or uniform distribution of the blank-holding force.

Since the number "M" of the test pressing cycles to be performed prior to an actual production run is determined as described above, the actual production run can be accomplished without an otherwise possible production of defective parts or rejects. Further, the present determination of the number "M" prevents an unnecessarily large number of test pressing cycles, which result in unnecessary deformation of the deformable members 116, leading to reduction of the number of actual pressing cycles that can be performed, and consequent lowering of the production efficiency of the press 110. To avoid the production of rejects, it is desirable that the number of actual test pressing cycles be slightly larger than the determined number "M". The above-indicated gaps between the deformable members 116 and the cushion pins 112 and the distribution of the gaps may be detected by measuring the parallelism of the slide plate 14 and cushion pad 84 with respect to the horizontal plane, or measuring the length dimensions of the cushion pins 112 (sampled ones of the cushion pins 112). In the latter case, a distribution of the length variations of the measured cushion pins 122 from the nominal length is obtained. The obtained distribution of the length variations corresponds to a distribution of the gap dimensions between the deformable members 116 and the cushion pins 122. Since the average gap dimension (average length variations) is equal to the above-indicated average deformation amount $dL_{av}$, the average gap dimension (average can be used as the critical dimension X, if the gap dimensions obtained by measurement of the length dimensions of the cushion pins 112 have a normal distribution. In this case, the distance of movement of the pressure ring 24 necessary to substantially eliminate the gaps for all the deformable members 116 (cushion pins 112) is equal to 2X.

While the present embodiment uses the equation (19) for obtaining by approximation the number "M" of the test pressing cycles to be performed, other equations may be used for obtaining the number "M" with higher accuracy.

The dimensions of the small-diameter portion 120, that is, the cross sectional area So and length L can be determined according to the above equation (19) so that the number "M" corresponding to the critical value X of the average deformation amount $dL_{av}$ is smaller than a desired upper limit. If the number "M" cannot be reduced below the desired upper limit due to dimensional or configurational restrictions of the deformable member 116 (small-diameter portion 120), the material, vertical plastic deformation coefficient E and Poisson's ratio $\nu$ of the deformable member 116 may also be suitably changed. The deformable member 116 need not be a solid cylindrical or columnar member, but may be a hollow member such as a hollow cylindrical member of a suitable material, which enables the number "M" to be smaller than the desired upper limit. While the holders 122 are used to secure the deformable members 116 to the pressure ring 24, any other suitable fixing means may be used depending upon the configuration of the deformable members 116. For instance, the deformable members 116 may be bolted directly to the pressure member 24.

In the present press 110 according to the fourth embodiment of this invention, the deformable members 116 are disposed in the respective transfer paths of the blank-holding force corresponding to the respective cushion pins 112, more specifically, between the lower surface of the pressure ring 24 and the respective cushion pins 112, for substantially even distribution of the blank-holding force over the entire area of the pressure ring 24. The present press 110 is also simpler in construction and less costly than the convention press which uses multiple balancing hydraulic cylinders whose oil chambers communicate with each other for even distribution of the blank-holding force. Further, the deformable members 116 may be applied to an existing press not equipped with such balancing cylinders. It is also noted that the number "M" of test pressing cycles necessary to assure even distribution of the blank-holding force during the actual production run can be suitably determined according to the above equation (19), or may be set at a desired value by suitably changing or selecting the dimensions (shape) and/or material of the deformable members 116. Thus, the present press 110 is capable of performing the production run with even distribution of the blank-holding force, while minimizing the required number of test pressing cycles.

Figure 9A:
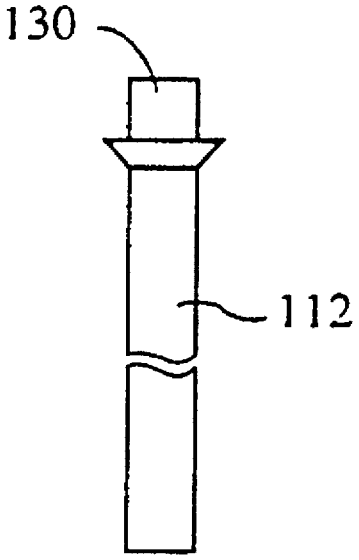
FIGS. 9(*a*), 9(*b*) and 9(*c*) are views showing deformable members disposed in various manners.
Figure 9B:
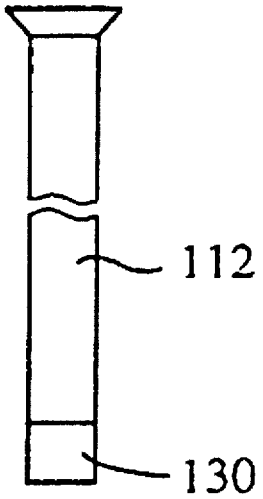
Figure 9C:
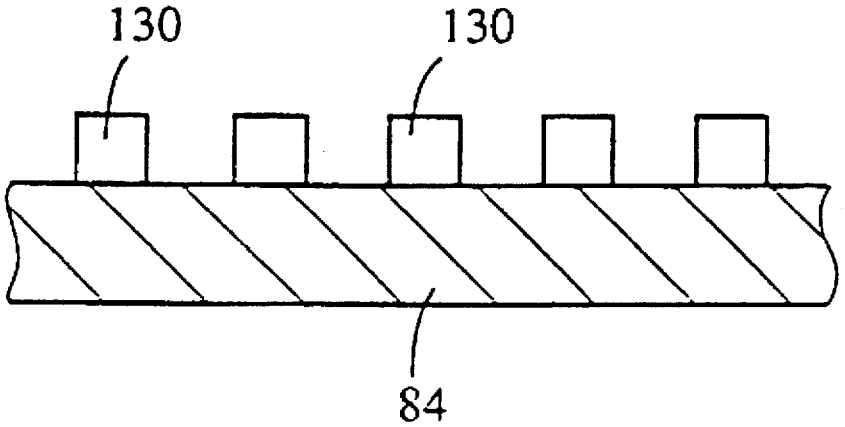

Although the fourth embodiment is adapted such that the deformable members 116 are attached to the lower surface of the pressure ring 24, the deformable members may be fixed to the upper or lower end faces of the respective cushion pins 112 by suitable fixing means such as bolts, as indicated at 130 in FIGS. 9(*a*) and 9(*b*). The deformable members 130 may be solid cylindrical members or partly-hollow cylindrical members. Further, the deformable members 130 may be interposed between upper and lower portions of the cushion pins 112. The cushion pins 112 may be inserted through through-holes formed through the bolster and suspended therefrom with the large-diameter upper end portions 114 engaging the upper open ends of the through-holes of the bolster, as in the presses 10, 80 shown in FIGS. 1 and 4. In this case, the deformable members 130 may be disposed in a matrix form on the cushion pad 84, as shown in FIG. 9(*c*) by way of example, such that the deformable members 130 are aligned with the respective through-holes of the bolster and the respective cushion pins 112, and are fixed to the upper surface of the cushion pad 84 by suitable fixing means, like the gas cylinders 40 provided on the press 10 of FIG. 1.

While the present invention has been described in detail by reference to the accompanying drawings for illustrative purpose only, it is to be understood that the invention may be otherwise embodied.

In the illustrated embodiments, the force applying means uses the pneumatic cylinder 34 for producing the blank-holding force based on the pneumatic pressure Pa. However, the principle of the present invention is equally applicable to a press which uses other types of force applying means for producing the blank-holding force. For instance, the force applying means may include a hydraulic cylinder, and relief means for discharging a working oil from the hydraulic cylinder during the downward movement of the cushion pad so as to produce the blank-holding force based on the relief pressure.

While the gas cylinders 40 used on the press 10 are fixed to the cushion pad 36, these gas cylinders 40 may be fixed to the lower surface of the pressure ring 24, like the deformable members 116 used on the press 110.

Figure 5:
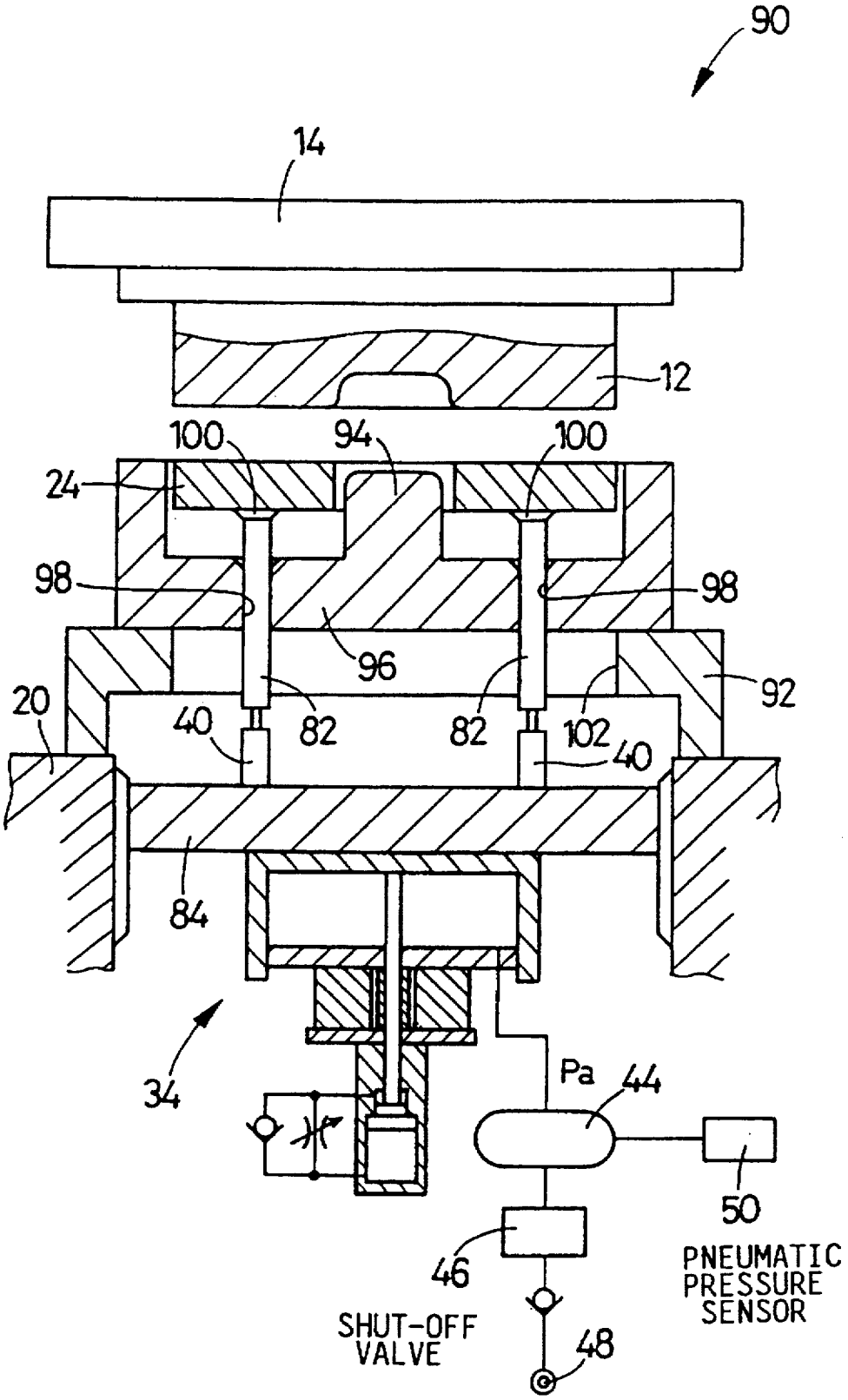
FIG. 5 is a cross sectional view of a press according to a further embodiment of the invention.

In the illustrated embodiments of FIGS. 1, 4 and 5, the pressure ring 24 has the initial height which is slightly higher than the upper end of the punch 16, 94. However, the initial height of the pressure ring 24 may be suitably determined depending upon the specific operating condition of the press such as the operating stroke of the pressure ring 24 (for obtaining the desired blank-holding force), that is, the distance Sp of downward movement of gas cylinder 40 for obtaining the predetermined force f. In the press 110 of FIG. 6, too, the height of the pressure ring 24 prior to test pressing cycles for compressive deformation of the deformable members 116 may be suitably determined depending upon the operating condition of the press such as the average amount of deformation of the deformable members 116 caused by the test pressing cycles, namely, the critical value X indicated above.

It is to be understood that the present invention may be made with various other changes, modifications and improvements, which may occur to those skilled in the art in the light of the foregoing teachings.

What is claimed is:

1. A press including (a) force applying means for producing a blank-holding force, (b) a cushion pad which receives said blank-holding force when said cushion pad is moved down, (c) a plurality of cushion pins disposed on said cushion pad, (d) a pressure member supported by said cushion pins at upper ends of the cushion pins remote from said cushion pad, so that said blank-holding force is transferred to said pressure member through said cushion pins to hold a blank placed on said pressure member, when said pressure member is moved down during a pressing operation on said blank, (e) a bolster disposed between said cushion pad and said pressure member, and (f) a lower die disposed on said bolster, at least one of said bolster and said lower die having a plurality of through-holes through which said cushion pins extend and by which said cushion pins are guided, said press comprising:

a plurality of mutually independent gas cylinders charged with a gaseous fluid, each of said gas cylinders having a piston fixed to an end of the corresponding one of said cushion pins, said gaseous fluid being compressed during downward movement of said pressure member, so as to establish substantially even distribution of said blank-holding force to said pressure member through all of said plurality of cushion pins, each of said mutually independent gas cylinders having an outside diameter not larger than that of said cushion pins, whereby said gas cylinders fixed to said cushion pins are permitted to pass through said through-holes upon installation of said gas cylinders together with said cushion pins.

2. A press according to claim 1, wherein each of said gas cylinders has a piston rod which is fixed to an end of the corresponding one of said cushion pins.

3. A press according to claim 2, wherein said piston rod is formed as an integral part of said corresponding one of said cushion pins.

4. A press according to claim 1, wherein each of said gas cylinders comprises a cylinder housing having a plurality of piston chambers, a plurality of pistons slidably received in said piston chambers, respectively, and a piston rod connected to said plurality of pistons such that said pistons are moved together as a unit, said piston chambers being arranged in a direction of movement of said pistons.

5. A press according to claim 4, wherein each of said plurality of piston chambers is divided by a corresponding one of said pistons into a gas chamber filled with said gaseous fluid and an atmospheric chamber communicating with an atmosphere, said gas chambers in said plurality of piston chambers communicating with each other.

6. A press according to claim 1, wherein said bolster has a plurality of through-holes formed therethrough, said cushion pins extending through selected ones of said through-holes and fixed to said gas cylinders such that said gas cylinders are placed on said cushion pad at respective positions that are aligned with said selected ones of said through-holes.

7. A press according claim 1, wherein said lower die has a plurality of through-holes, and said bolster has a cutout formed in a portion thereof aligned with a portion of said lower die in which said through-holes are formed, said cushion pins extending through selected ones of said pad at a respective positions that are aligned with said selected ones of said through-holes.

8. A press including (a) force applying means for producing a blank-holding force, (b) a cushion pad which receives said blank-holding force when said cushion pad is moved down, (c) a plurality of cushion pins disposed on said cushion pad, (d) a pressure member supported by said cushion pins at upper ends of the cushion pins remote from said cushion pad, so that said blank-holding force is transferred to said pressure member through said cushion pins to hold a blank placed on said pressure member, when said pressure member is moved down during a pressing operation on said blank, (e) a bolster disposed between said cushion pad and said pressure member and having a plurality of through-holes through which said cushion pins extend, and (f) a lower die disposed on said bolster, and having a plurality of through-holes through which said cushion pins extend, respectively, said press comprising:

a plurality of mutually independent gas cylinders charged with a gaseous fluid, each of said gas cylinders having a piston fixed to an end of the corresponding one of said cushion pins, said gaseous fluid being compressed during downward movement of said pressure member, so as to establish substantially even distribution of said blank-holding force to said pressure member through all of said plurality of cushion pins, each of said mutually independent gas cylinders having an outside diameter not larger than that of said cushion pins, whereby said gas cylinders fixed to said cushion pins are permitted to pass through said through-holes of said lower die upon installation of said gas cylinders together with said cushion pins.

9. A press including (a) force applying means for producing a blank-holding force, (b) a cushion pad which receives said blank-holding force when said cushion pad is moved down, (c) a plurality of cushion pins disposed on said cushion pad, and (d) a pressure member supported by said cushion pins at upper ends of the cushion pins remote from said cushion pad, so that said blank-holding force is transferred to said pressure member through said cushion pins to hold a blank placed on said pressure member, when said pressure member is moved down during a pressing operation on said blank, said press comprising:

a plurality of plastically deformable members disposed in respective transfer paths of said blank-holding force which correspond to said plurality of cushion pins, respectively, said plastically deformable members being plastically deformed due to application thereto of said blank-holding force during downward movements of said pressure member in pressing cycles of said press, whereby dimensional and positional errors of the press which cause a variation of length of said transfer paths between said cushion pad and said pressure member are absorbed by plastic deformation of said plastically deformable members, so as to establish substantially even distribution of said blank-holding force to said pressure member through all of said plurality of cushion pins.

10. A press according to claim 9, wherein said plurality of plastically deformable members are fixed to a lower surface of said pressure member.

11. A press according to claim 9, wherein said plurality of plastically deformable members are fixed to upper ends of said plurality of cushion pins, respectively.

12. A press according to claim 9, wherein said plurality of plastically deformable members are fixed to lower ends of said plurality of cushion pins, respectively.

13. A press according to claim 9, wherein said plurality of plastically deformable members are fixed to an upper surface of said cushion pad.

14. A press according to claim 9, wherein each of said deformable members includes a plastically deformable solid member.

15. A press according to claim 9, further including a stationary bolster disposed above said cushion pad, and a lower die disposed on said bolster, and wherein said lower die has a plurality of through-holes, and said bolster has a cutout formed in a portion thereof aligned with a portion of said lower die in which said through-holes are formed, said cushion pins extending through selected ones of said through-holes and through said cutout and associated with said plastically deformable members.

16. A method of establishing substantially even distribution of a blank-holding force to a pressure member through all of a plurality of cushion pins on a press which includes force applying means for producing said blank-holding force, and a cushion pad which receives said blank-holding force when said cushion pad is moved down, and wherein said cushion pins disposed on said cushion pad, and said pressure member is supported by said cushion pins at upper ends of the cushion pins remote from said cushion pad, so that said blank-holding force is transferred to said pressure member through said cushion pins to hold a blank placed on said pressure member when said pressure member is moved down during a pressing operation on said blank, said method comprising:

disposing a plurality of plastically deformable members disposed in respective transfer paths of said blank-holding force which correspond to said plurality of cushion pins, respectively; and effecting downward movement of said pressure member repeatedly so as to apply said blank-holding force to said plastically deformable members for thereby deforming said plastically deformable members, to absorb dimensional and positional errors of the press which cause a variation of length of said transfer paths between said cushion platen and said pressure member, so that the plastic deformation of said plastically deformable members establishes substantially even distribution of said blank-holding force to said pressure member through all of said plurality of cushion pins.

17. The method according to claim 16, wherein said step of effecting downward movements of said pressure member comprises performing test pressing operations prior to a production run of the press.

* * * * *